US005970753A

United States Patent [19]

Johnson et al.

[11] Patent Number: 5,970,753

[45] Date of Patent: Oct. 26, 1999

[54] DRAIN FOR WASHING MACHINE DOOR BOOT

[75] Inventors: Troy A. Johnson; William A. Jensen, both of Newton, Iowa

[73] Assignee: Maytag Corporation, Newton, Iowa

[21] Appl. No.: 09/135,391

[22] Filed: Aug. 17, 1998

[51] Int. Cl.[6] ..... D06F 39/02; D06F 39/08

[52] U.S. Cl. ..... 68/17 R; 68/207; 68/208

[58] Field of Search ..... 68/17 R, 207, 68/208, 58

[56] References Cited

U.S. PATENT DOCUMENTS 2,959,044 11/1960 Stone ..... 68/207 X
3,080,252 3/1963 Freier et al. ..... 68/17 R X
5,513,504 5/1996 Sribar et al. .
5,548,978 8/1996 Bongini et al. .

FOREIGN PATENT DOCUMENTS 2 023 186 12/1979 United Kingdom .

*Primary Examiner*—Philip R. Coe
*Attorney, Agent, or Firm*—Zarley, McKee, Thomte, Voorhees & Sease

[57] ABSTRACT

A boot drain for horizontal axis washing machines includes an elongated hollow tube with a forward end disposed within a lower portion of the boot, and a rearward end disposed within the tub to drain fluid from the lower portion of the boot into the tub. Preferably the tube has an inverted U-shape which creates a siphon to remove pooled liquid within the boot and to transfer the liquid to the tub.

4 Claims, 5 Drawing Sheets

DRAIN FOR WASHING MACHINE DOOR BOOT

BACKGROUND OF THE INVENTION

The present invention relates generally to horizontal axis washing machines, and more particularly to a drain for the door boot connected between the washer tub of the machine and the associated washer housing.

The horizontal axis washing machine has become more and more popular recently, and generally includes an access door in the front of the washing machine. Because the orientation of the tub within the washing machine is substantially horizontal, a flexible boot interconnects the tub with the forward wall of the cabinet of the washing machine to provide a flexible seal.

The movement of the tub defines the shape of the boot between the tub and the cabinet. In some boot shapes, the lower area of the boot can allow water to collect that has splashed out of the tub. Retention of water in a pool can thereby become a potential source of odor.

SUMMARY OF THE INVENTION

It is therefore a general object of the present invention to provide an improved boot for horizontal axis washing machines which includes a drain to remove water retained in low portions of the boot.

Another object is to provide a boot drain which automatically removes collected water in the boot during the conventional cycle of the washing machine.

A further object of the present invention is to provide a boot drain for horizontal axis washing machine which is economical to manufacture and efficient in operation.

These and other objects of the present invention will be apparent to those skilled in the art.

The boot drain for horizontal axis washing machines of the present invention includes an elongated hollow tube with forward end disposed within a lower portion of the boot, and a rearward end disposed within the tub to drain fluid from the lower portion of the boot into the tub. Preferably, the tube has the shape of an inverted U and creates a siphon to remove pooled liquid from the boot, transferring the liquid into the tub.

DETAILED DESCRIPTION OF THE PREFERRED EMBODIMENT

Figure 1:
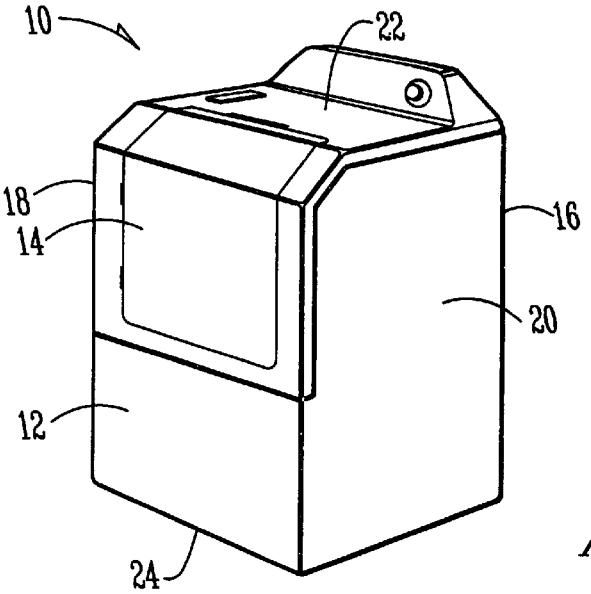
FIG. 1 is a perspective view of a horizontal axis washing machine.

Referring now to the drawings, in which similar or corresponding parts are identified with the same reference numeral, and more particularly to FIG. 1, a horizontal axis washing machine using the boot drain of the present invention is designated generally at 10 and includes a forward wall 12 with an operable door 14, a rearward wall 16, opposing side walls 18 and 20 and upper and lower walls 22 and 24.

Figure 2:
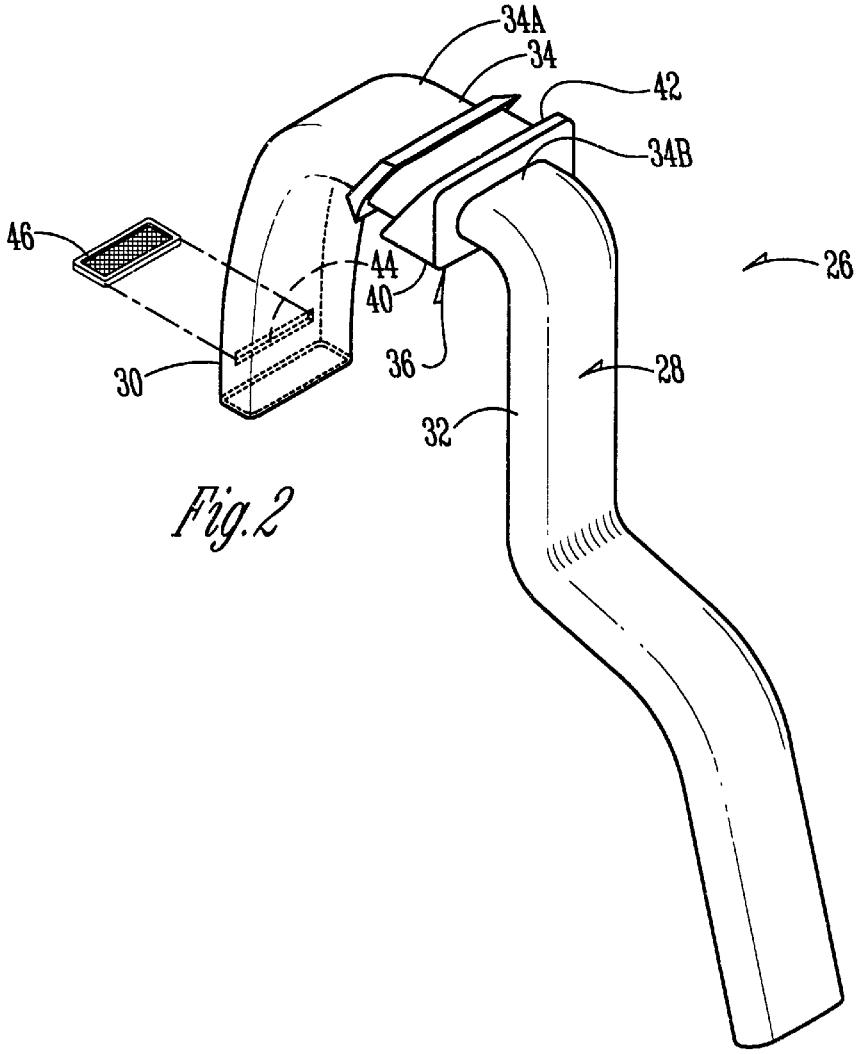
FIG. 2 is a perspective view of the boot drain of the present invention.

Referring now to FIG. 2, the boot drain of the present invention is designated generally at 26 and includes an elongated inverted U-shaped hollow tube 28 having a generally vertically oriented forward leg 30 connected to a generally vertically oriented rearward leg 32 by a generally horizontally oriented cross-member 34. Forward leg 30 is formed of a resilient flexible material such as rubber, as is the forward portion 34*a* of cross-member 34. The rearward portion 34*b* of cross-member 34, and rearward leg 32, are both preferably formed of a substantially rigid plastic material.

Figure 5:
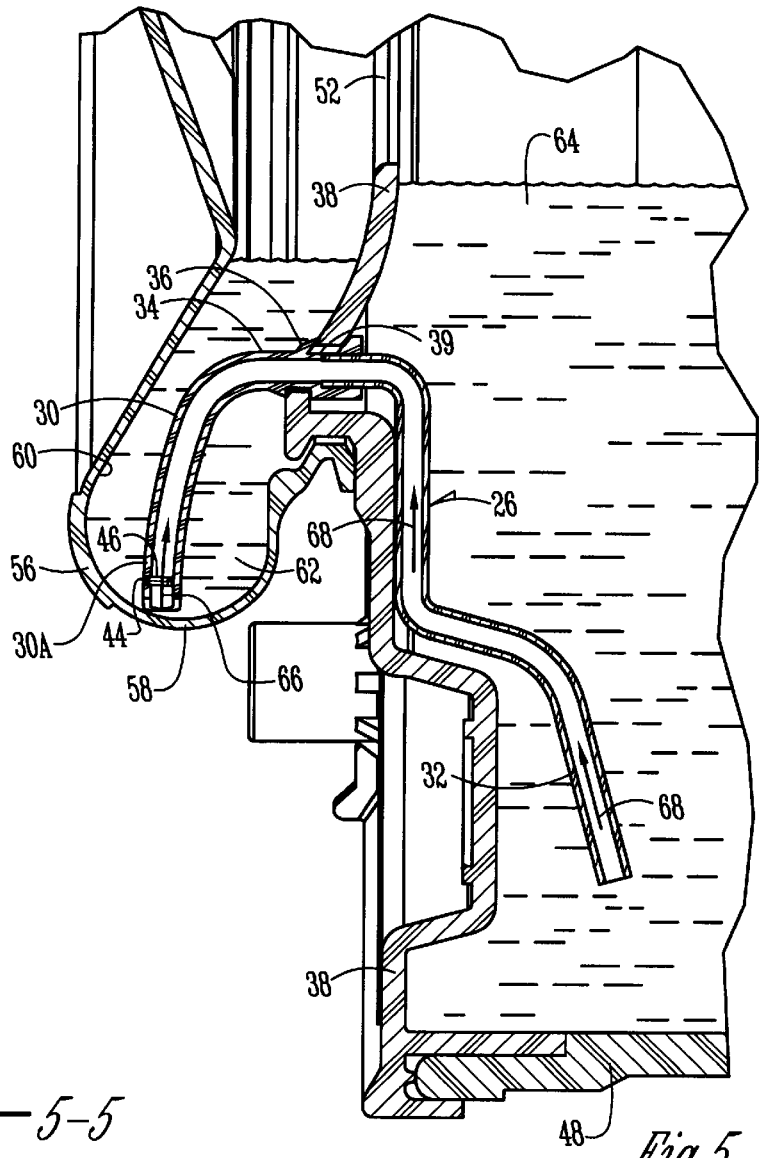
FIG. 5 is an enlarged sectional view similar to FIG. 4, showing a first step in the operation of the boot drain.

An enlarged portion of cross-member 34 forms a connector member 36, which is used to attach the boot drain 26 to the tub cover 38 through an aperture 39(shown in FIG. 5). Connector member 36 includes a peripheral wall 40 generally parallel to the longitudinal axis of cross-member 34. A groove 42 is formed in the peripheral wall and extends continuously around the entire periphery of the peripheral wall. Groove 42 has a width for receiving the thickness of the tub cover 38 therein at aperture 39, to secure boot drain 26 to the tub cover 38.

A slot 44 is formed in one side wall of tube forward leg 30 for receiving a fine mesh screen 46. Screen 46 acts as a filter to prevent the passage of particulate and the like through the tube, but has an opening size permitting the free flow of liquid therethrough.

Figure 3:
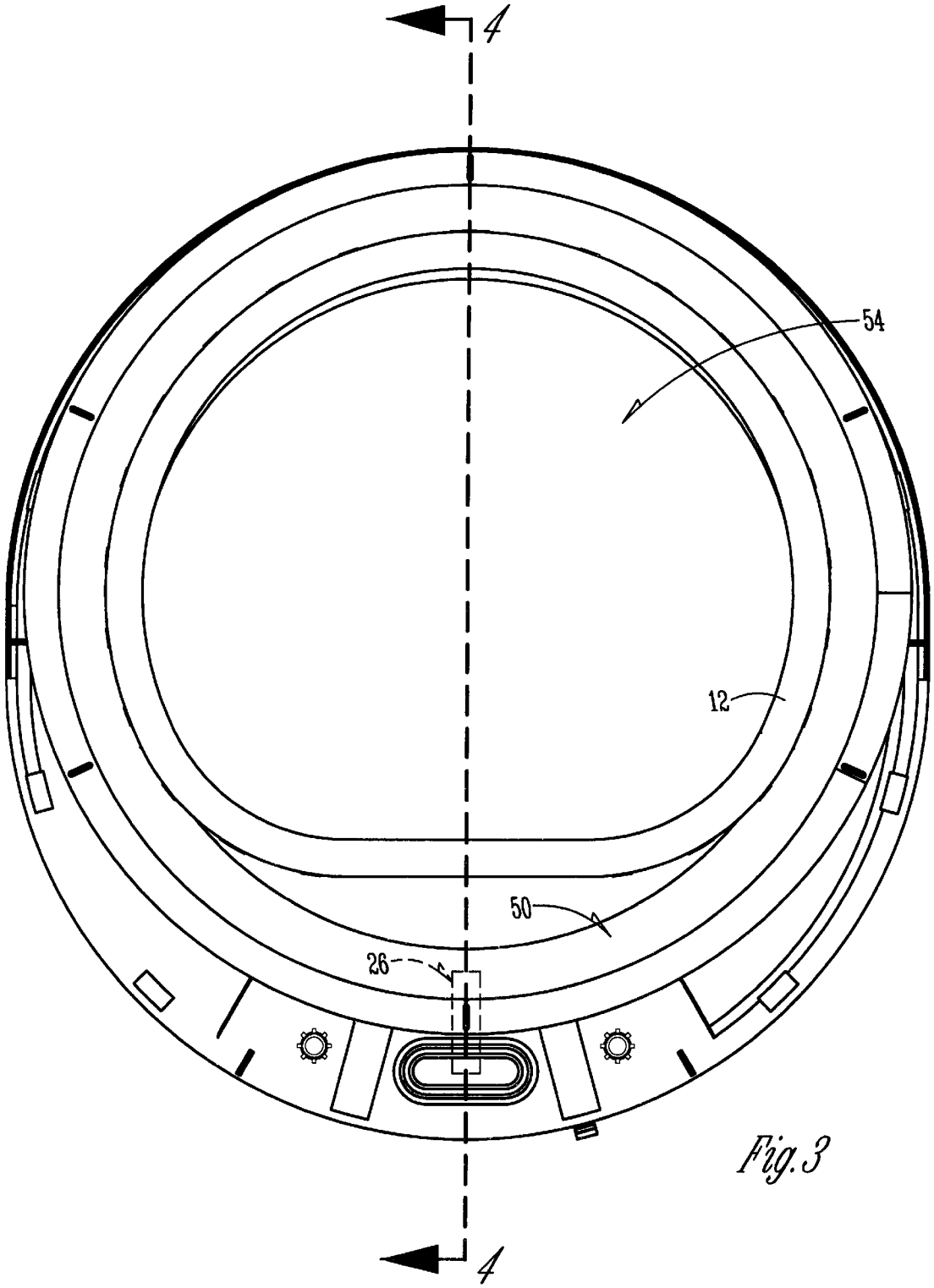
FIG. 3 is a front elevational view of the boot, mounted on the forward end of the washer tub.
Figure 4:
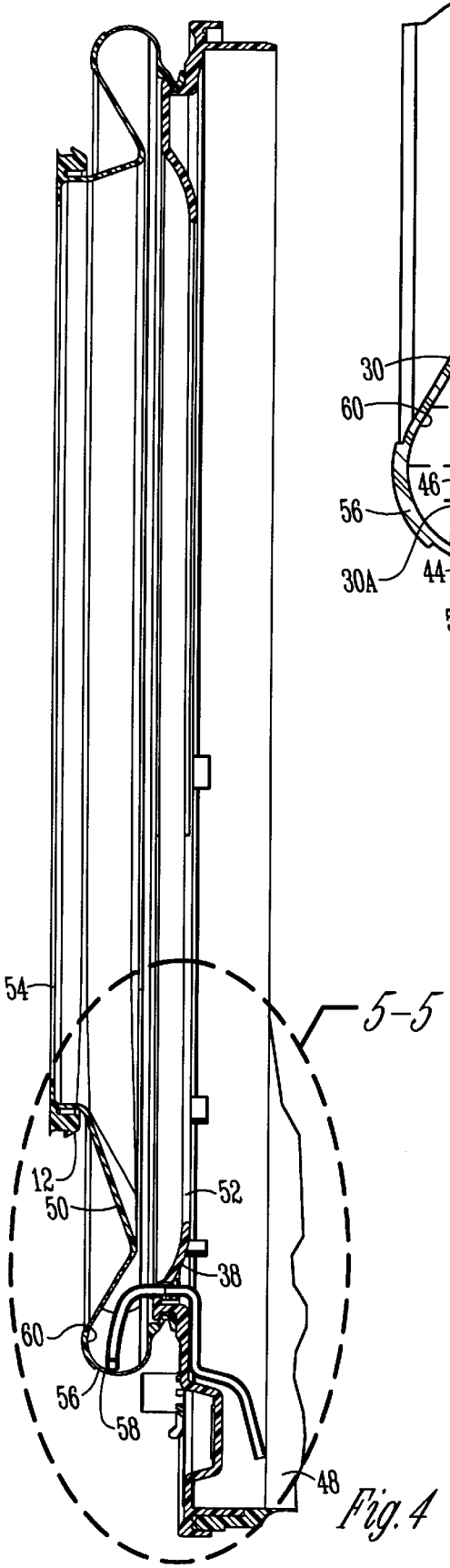
FIG. 4 is a sectional view taken at lines 4—4 in FIG. 3.

Referring now to FIGS. 3 and 4, a tub 48 is shown with a resilient flexible boot 50 connected between the tub cover 38 on tub 48 and the housing forward wall 12. As shown in FIG. 4, tub cover 38 is a generally annular member with a central opening 52 permitting access to the mouth of the tub 48. The housing forward wall 12 also has an opening 54 aligned with the tub cover opening 52, for accessing the interior of tub 48.

Boot 50 is a resilient flexible member which is annular in shape, and connected between housing forward wall 12 and tub cover 38 and extending continuously around forward wall opening 54 and tub cover opening 52. Boot 50 has a lower portion 56 which has a generally U-shaped cross-sectional shape. The base 58 of the U-shape lower portion 56 is spaced vertically below a lower edge of the tub cover opening 52 as well as below a lower edge of the forward wall opening 54, forming a cavity 60 into which water from tub 48 may be splashed and retained to form a pool.

Referring now to FIG. 5, it can be seen that the boot drain 26 is connected to tub cover 38, with forward leg 30 projecting forwardly into cavity 60 of boot lower portion 56. A lower end 30*a* of forward leg 30 is disposed proximal to the base 58 of boot lower portion 56 to substantially remove all liquid 62 within boot lower portion 56. Rearward leg 32 is longer than forward leg 30, and thereby extends downwardly within tub 48 a vertical distance greater than the downward extent of drain forward leg 30. As discussed in more detail hereinbelow, this permits siphoning action to remove liquid 62 from boot lower portion 56.

During the fill cycle liquid is sprayed into tub 48. As liquid enters the tub 48, the boot drain 26 fills from rearward leg 32 as shown by arrow 68.

Some of the liquid 64 being sprayed into the tub 48 will splash through the tub cover opening 52 into the boot cavity

60, and be retained therein as a liquid pool 62. If the liquid level in the tub 48 is below the level of pool 62 when liquid is introduced into the lower portion 56 of boot 50, the liquid fills the boot drain 26 from the lower end 30*a* as shown by arrow 66.

Figure 6:
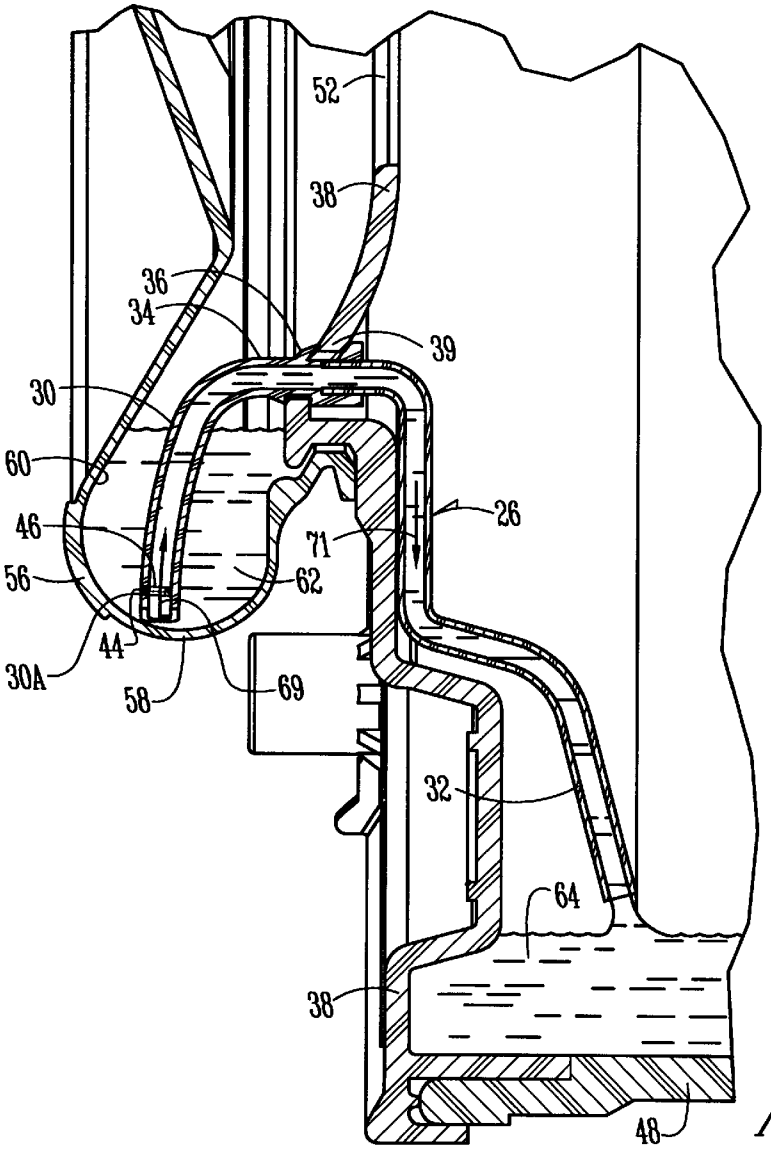
FIG. 6 is a view similar to FIG. 5, showing the siphoning action of the boot drain.

During the washing and spinning cycles of the washer the level of the liquid in tub 48 will drop. As the liquid level in tub 48 drops below the liquid level of the liquid in boot cavity 60, boot drain will act as a siphon to equalize the liquid levels in tub 48 and boot cavity 60. At the end of the cycles the liquid level in tub 48 drops below lower end 30A of forward leg 30. This causes boot drain 26 to act as a siphon to remove liquid 62 from cavity 60, and drain the fluid into tub 48 in the direction indicated by arrows 69, 71 in FIG. 6. Because lower leg 32 extends downwardly farther than forward leg 30, substantially all of liquid 62 will be removed from boot lower portion 56.

Figure 7:
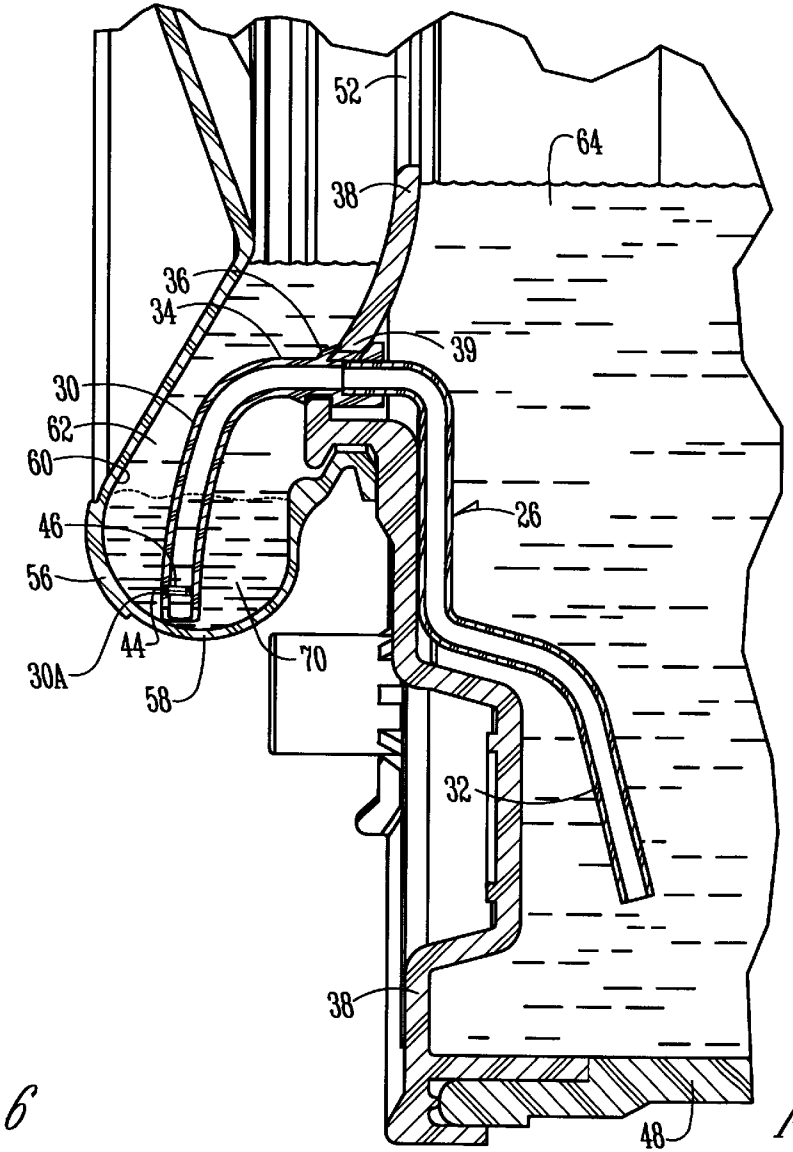
FIG. 7 is a view similar to FIG. 5, but showing a second method of operation of the boot drain.
Figure 8:
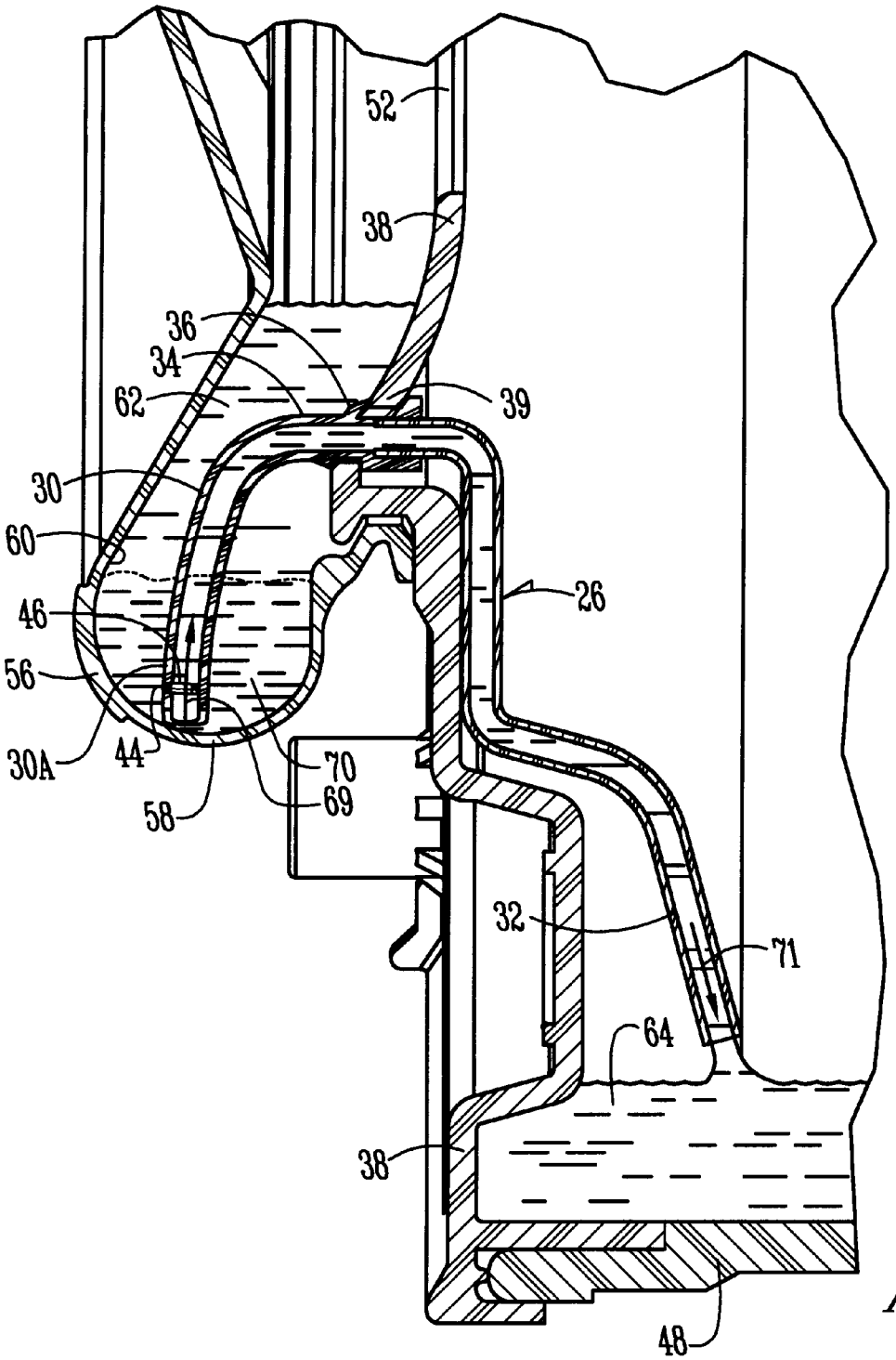
FIG. 8 is a view similar to FIG. 7, showing a second step in the second method of operation of the boot drain.

Referring now to FIGS. 7 and 8, boot drain 26 permits a consumer to utilize the siphoning action from boot 50, to dispense liquid detergent 70 into tub 48.

As shown in FIG. 7, liquid detergent 70 is placed within boot lower portion 56 prior to initiation of the washing cycle. Once the washing cycle begins, water 64 from tub 48 will splash into cavity 60 to form liquid pool 62 intermixed with liquid detergent 70. As the water level within boot 50 rises above cross member 34 of boot drain 26, a siphoning action will occur within boot drain 26, thereby dispensing liquid detergent 70 and water 62 from boot lower portion 56 into tub 48 as shown by arrows 69, 71 in FIG. 8.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A washing machine, comprising:

an enclosed housing having upper and lower walls, forward and rearward walls and opposing side walls;

a tub mounted within the housing and oriented generally horizontally, with a forwardly oriented open mouth;

an annular tub cover mounted on the mouth of the tub, having a central opening permitting access to an interior of the tub, and extending substantially with a plane orthogonal to a longitudinal axis of the tub;

said housing forward wall having an opening aligned with the tub cover central opening, for accessing the tub interior;

a resilient, flexible, annular boot connected between the housing forward wall and the tub cover, and extending continuously around the forward wall opening and the tub cover central opening;

said boot having a lower portion including a generally U-shaped cross-sectional shape, with a base of the "U" shape spaced vertically below a lower edge of the tub cover central opening and below a lower edge of the forward wall opening; and a drain mounted in the boot lower portion, comprising:

an elongated hollow tube having a forward end disposed proximal the base within the boot lower portion;

said tube having a second end disposed within the tub, for draining fluid from the boot lower portion into the tub.

2. The washing machine of claim 1, wherein the tub cover has an aperture formed in a lower portion thereof, and wherein said tube is journaled through the tub cover aperture.

3. The washing machine of claim 2, wherein said tube includes a connector member thereon, between the ends of the tube, having means for connecting the connector member to the tub cover for preventing movement of the tube through the aperture.

4. A washing machine, comprising:

an enclosed housing having upper and lower walls, forward and rear walls, and opposing side walls;

a tub mounted within the housing and having an open mouth;

a flexible annular boot connected to the housing and having a lower portion being generally U-shaped in cross section;

an elongated drain tube having a first end disposed within the boot lower portion and a second end disposed within the tub for draining fluid from the boot lower portion into the tub.

* * * * *